US012227851B2

(12) United States Patent
Fujiwara et al.

(10) Patent No.: US 12,227,851 B2
(45) Date of Patent: Feb. 18, 2025

(54) HIGH-STRENGTH Zn—Al—Mg-BASED SURFACE-COATED STEEL SHEET AND METHOD FOR PRODUCING SAME

(71) Applicant: NIPPON STEEL NISSHIN CO., LTD., Tokyo (JP)

(72) Inventors: Susumu Fujiwara, Tokyo (JP); Shinya Uesugi, Tokyo (JP); Tomoharu Shigetomi, Tokyo (JP)

(73) Assignee: NIPPON STEEL NISSHIN CO., LTD., Tokyo (JP)

( * ) Notice: Subject to any disclaimer, the term of this patent is extended or adjusted under 35 U.S.C. 154(b) by 277 days.

(21) Appl. No.: 16/615,955

(22) PCT Filed: Sep. 1, 2017

(86) PCT No.: PCT/JP2017/031654
§ 371 (c)(1),
(2) Date: Nov. 22, 2019

(87) PCT Pub. No.: WO2018/220873
PCT Pub. Date: Dec. 6, 2018

(65) Prior Publication Data

US 2020/0173004 A1 Jun. 4, 2020

(30) Foreign Application Priority Data

Jun. 1, 2017 (JP) ..... 2017-109575

(51) Int. Cl.
*C23C 2/06* (2006.01)
*C21D 3/06* (2006.01)
(Continued)

(52) U.S. Cl.
CPC ..... *C23C 2/06* (2013.01); *C21D 3/06* (2013.01); *C21D 8/0205* (2013.01); *C22C 18/04* (2013.01);
(Continued)

(58) Field of Classification Search
CPC ..... C21D 3/06; C21D 8/0205; C23C 2/02; C23C 2/06; C23C 2/26; C23C 2/28
See application file for complete search history.

(56) References Cited

U.S. PATENT DOCUMENTS

2015/0072166 A1* 3/2015 Nakano ..... C23C 28/345 428/623
2020/0032364 A1* 1/2020 Hirashima ..... C23C 2/06

FOREIGN PATENT DOCUMENTS

JP 07-150241 6/1995
JP 10-317121 12/1998
(Continued)

OTHER PUBLICATIONS

Nisshin Steel Quality products. "ZAM" 2015. p. 1-39. (Year: 2015).*
(Continued)

*Primary Examiner* — Nicholas A Wang
(74) *Attorney, Agent, or Firm* — Bauer & Joseph

(57) ABSTRACT

A high-strength surface-coated steel sheet includes a base steel sheet having a composition by mass of C: 0.01 to 0.20%, Si: 0.01 to 0.50%, Mn: 0.10 to 2.50%, P: 0.005 to 0.050%, B: 0.0005 to 0.010%, Ti: 0.01 to 0.20%, Nb: 0 to 0.10%, Mo: 0 to 0.50%, Cr: 0 to 0.50%, Al: 0.01 to 0.10%, and the balance of Fe and inevitable impurities; and a Zn—Al—Mg-based coating layer disposed on a surface of the base steel sheet, The steel sheet has a diffusible hydrogen concentration in the base steel sheet of 0.30 ppm or less and having a time until occurrence of red rust of 7000 hours or more as measured by a salt spray test. The high-strength hot-dip Zn—Al—Mg-based-plated steel sheet has a significantly lowered in-steel concentration of hydrogen which has entered the steel in a plating line and exhibits excellent corrosion resistance.

9 Claims, 2 Drawing Sheets

(51) Int. Cl.

| | |
|---|---|
| ***C21D 8/02*** | (2006.01) |
| ***C22C 18/04*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/32*** | (2006.01) |
| ***C23C 2/02*** | (2006.01) |
| ***C23C 2/26*** | (2006.01) |
| ***C23C 2/28*** | (2006.01) |

(52) U.S. Cl.

CPC ..... *C22C 38/02* (2013.01); *C22C 38/04* (2013.01); *C22C 38/06* (2013.01); *C22C 38/12* (2013.01); *C22C 38/14* (2013.01); *C22C 38/32* (2013.01); *C23C 2/02* (2013.01); *C23C 2/022* (2022.08); *C23C 2/0222* (2022.08); *C23C 2/0224* (2022.08); *C23C 2/024* (2022.08); *C23C 2/26* (2013.01); *C23C 2/28* (2013.01)

(56) References Cited

FOREIGN PATENT DOCUMENTS

| | | | |
|---|---|---|---|
| JP | H11200000 | * | 7/1999 |
| JP | 2006-037130 | | 2/2006 |
| JP | 200637130 | * | 2/2006 |
| JP | 2008-279071 | | 11/2008 |
| JP | 2012-172247 | | 9/2012 |
| JP | 5097305 | | 12/2012 |
| JP | 2013-142198 | | 7/2013 |
| JP | 2013241665 | * | 12/2013 |
| WO | 2007/052683 | | 5/2007 |
| WO | 2013/133270 | | 9/2013 |

OTHER PUBLICATIONS

Nisshin Steel Quality Products. 2015. ZAM. p. 1-39 (Year: 2015).*

Miami Valley Steel Service. "Galvannealed." 2016. Retrieved from: https://web.archive.org/web/20160331174033/https://www.miamivalleysteel.com/galvannealed/ (Year: 2016).*

Yasuhide Morimoto et al., "Excellent Corrosion-resistant Zn—Al—Mg—Si Alloy Hot-Dip Galvanized Steel Sheet 'Superdyma'", Nippon Steel Technical Report, 2002, No. 377, pp. 22-24.

F. Yuse et al., "Relationships Between Delayed Fracture and Diffusible Hydrogen of Electrogalvanized Bold Steel", Kobe Steel Engineering Reports, Apr. 2000, vol. 50, No. 1, p. 65.

* cited by examiner

[Fig.1]
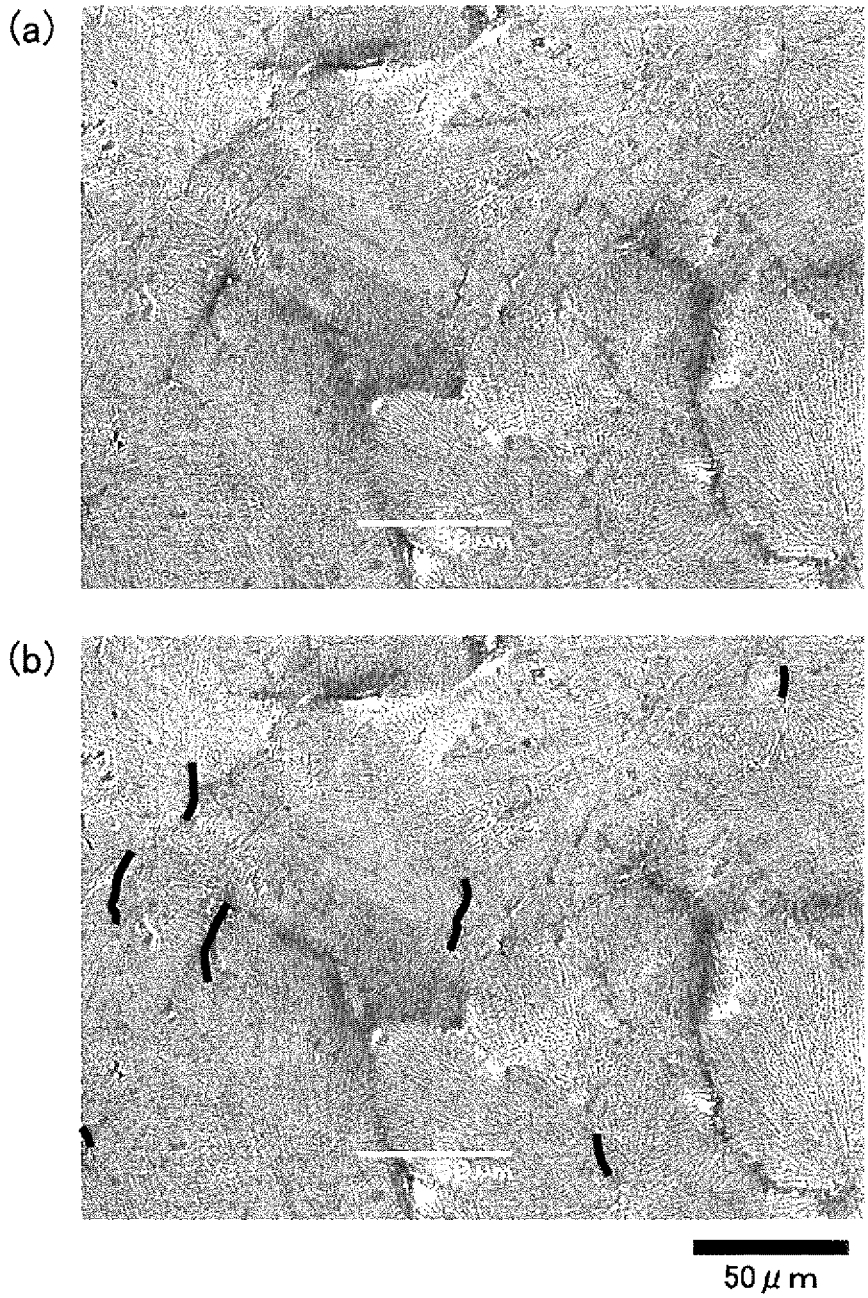

[Fig.2]
(a)
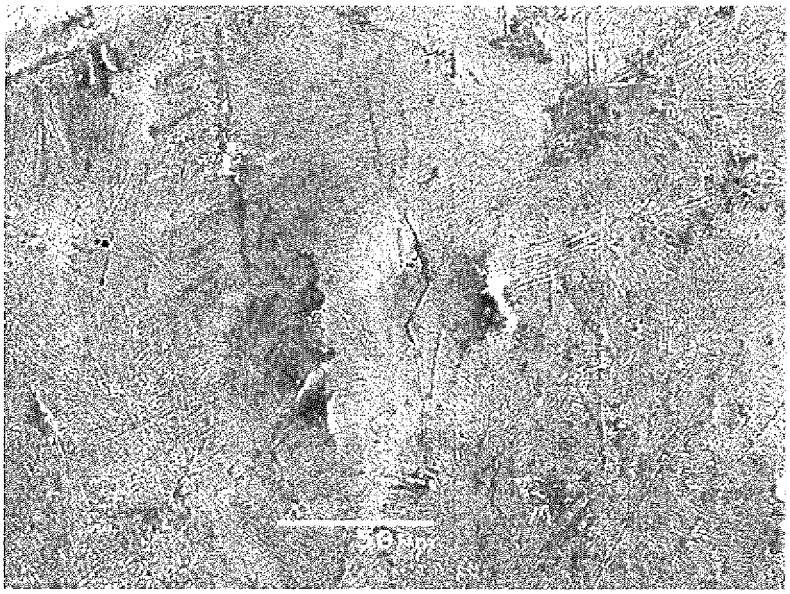
(b)
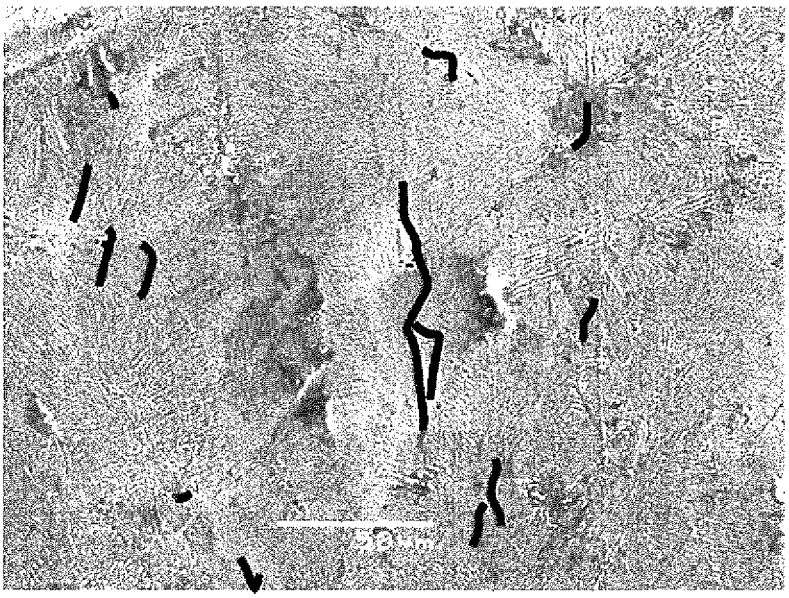
50 μm

HIGH-STRENGTH Zn—Al—Mg-BASED SURFACE-COATED STEEL SHEET AND METHOD FOR PRODUCING SAME

TECHNICAL FIELD

The present invention relates to a surface-treated steel sheet in which a Zn—Al—Mg-based surface-coating layer is formed on a surface of a high-strength steel sheet, and in particular, the present invention relates to such a high-strength surface-coated steel sheet that is lowered in an in-steel hydrogen concentration which becomes a factor of hydrogen embrittlement while maintaining high corrosion resistance. The present invention also relates to a method for producing the same.

BACKGROUND ART

In recent years, there have been increasing needs for high-strength high-rustproofing steel sheets aimed at weight reduction and resource conservation in the field of automobiles and building materials. It is important that such a high-strength high-rustproofing steel sheet is superior not only in strength and corrosion resistance but also in workability since such a steel sheet is to be subjected to various workings, such as press working and bending working. An example of a highly rustproofing surface-treated steel sheet which has recently been increasingly needed is a hot-dip Zn—Al—Mg-based-plated steel sheet. However, when a high-tensile steel is used as a base steel sheet for this type of plated steel sheet, so-called hydrogen embrittlement is likely to occur due to hydrogen which inevitably enters the steel in a plating line, which may be troublesome depending on the application. In a general hot-dip galvanizing line, a base steel sheet which is a base steel sheet for plating is subjected to a heat treatment in a reducing atmosphere containing hydrogen gas immediately before a plating bath. Hydrogen in the heating atmosphere enters the base steel sheet and may cause hydrogen embrittlement. Hydrogen entrance also possibly occurs in a wet step, such as electrolytic degreasing, conducted before plating, which also may become a factor of hydrogen embrittlement.

It is known that hydrogen embrittlement in a plated steel sheet typically occurs due to hydrogen occlusion in an electroplating step or an acid cleaning step as a pretreatment thereof, and is likely to be a problem especially when a high-tensile steel of a 980-MPa or higher grade is used as a base steel sheet for plating. In a hot-dip Zn—Al—Mg-based-plated steel sheet, however, even when a high-tensile steel of a relatively low strength level, such as a 780-MPa grade or even a 590-MPa grade, is used, a very heavy working, such as close contact bending, may lead to brittle fracture. It has been found from detailed studies by the present inventors that the brittle fracture of this type is an event caused by hydrogen having entered in a plating line. It has also been found that, in a hot-dip Zn—Al—Mg-based-plated steel sheet, the plating layer is more likely to become a "barrier" that prevents release of hydrogen from the steel sheet as compared with another general hot-dip galvanized steel sheet. Accordingly, in order to increase the level of reliability for working of a high-strength steel sheet after subjected to hot-dip Zn—Al—Mg-based plating, there is a need for establishment of a technique for suppressing hydrogen embrittlement of the steel sheet.

CITATION LIST

Patent Literature

PTL 1: JP-A-7-150241
PTL 2: JP-A-2012-172247
PTL 3: Japanese Patent No. 5097305

Non-Patent Literature

NPL 1: Kobe Steel Engineering Reports, Vol. 50, No. 1, p. 65

SUMMARY OF INVENTION

Technical Problem

As a method for addressing hydrogen embrittlement of a steel sheet, PTL 1 discloses a technique for suppressing entrance of hydrogen generated in a corrosion reaction under the atmospheric environment into a steel sheet by optimizing the chemical composition and metallic structure of the steel. PTL 2 discloses a technique for suppressing hydrogen embrittlement due to hydrogen having entered from an environment by reducing microsegregation of Mn at a position deeper than the pitting corrosion depth of the surface. These techniques are a countermeasure against hydrogen entrance in the case where a steel sheet is used in a corrosion environment and are not efficient for hydrogen that has already entered in a hot-dip plating line.

A baking treatment is known as a treatment for releasing hydrogen having entered a steel material to the outside of the steel material. A baking treatment is a treatment of heating a steel material that hydrogen has entered at a temperature around 200° C. to allow the hydrogen having entered the steel material to diffuse and exit the surface of the steel material. NPL 1 has a statement about a baking treatment of a steel bolt having been subjected to electrogalvanizing. According to the statement, heating at 150° C. or higher is effective for releasing diffusible hydrogen and heating at about 200° C. is particularly effective. However, in the case of a steel material having been subjected to a hot-dip Zn—Al—Mg-based plating, heating to a temperature range higher than 150° C. leads to change of the phase structure of the plating layer, making it difficult to sufficiently maintain the inherent excellent corrosion resistance of a hot-dip Zn—Al—Mg-based plating layer. Accordingly, in a hot-dip Zn—Al—Mg-plated steel sheet, it has not been easy to efficiently release hydrogen having entered a steel material while maintaining excellent corrosion resistance thereof.

In addition, in a baking treatment, discoloration due to oxidation is generally liable to occur. Since it is difficult to remove hydrogen in a steel in a reducing atmosphere where, for example, hydrogen is used, a treatment in a vacuum furnace is required for completely preventing the discoloration on baking. Since such a treatment leads to an increase in cost, the treatment is difficult to employ in a plated steel sheet as a working material despite a practical aspect as a treatment on a high-strength component after working. Uneven discoloration on a surface is often noticeable especially in the case of a steel sheet. Thus, it is generally not easy to obtain a steel sheet material excellent in evenness in the surface appearance by a baking treatment.

Meanwhile, PTL 3 discloses a technique of forming a coating which is black due to a black oxide of Zn by heating a hot-dip Zn—Al—Mg-plated steel sheet in a steam atmosphere as a post-treatment. However, the document shows no example of applying a high-tensile steel as a base steel sheet for plating.

An object of the present invention is to provide a high-strength steel sheet having been subjected to hot-dip Zn—Al—Mg-based plating, the steel sheet being significantly lowered in the in-steel concentration of hydrogen having entered the steel in a plating line, while exhibiting the inherent excellent corrosion resistance of a hot-dip Zn—Al—Mg-based plating layer. The present invention also discloses a technique for improving the design properties of the surface appearance in such a steel sheet.

Solution to Problem

As a result of detailed studies, the present inventors have found that when a hot-dip Zn—Al—Mg-based-plated steel sheet in which a high-tensile steel is used as a base steel sheet for plating is subjected to bending-stretching deformation with a tension leveler or a skin pass rolling to thereby generate cracks in a plating layer, followed by a baking treatment, it is possible to efficiently release hydrogen having entered the steel material even if the baking temperature is set within a low temperature range of 150° C. or lower. In this case, the inherent high corrosion resistance of a hot-dip Zn—Al—Mg-based plating layer can be sufficiently maintained. It has also been found that when the baking treatment is conducted in a steam atmosphere, a coating layer having a black appearance which has high design properties can be obtained. The present invention has been completed based on the findings.

The above object is achieved by a high-strength surface-coated steel sheet including: a base steel sheet having a steel composition by mass of C: 0.01 to 0.20%, Si: 0.01 to 0.50%, Mn: 0.10 to 2.50%, P: 0.005 to 0.050%, B: 0.0005 to 0.010%, Ti: 0.01 to 0.20%, Nb: 0 to 0.10%, Mo: 0 to 0.50%, Cr: 0 to 0.50%, Al: 0.01 to 0.10%, and the balance of Fe and inevitable impurities; and a Zn—Al—Mg-based coating layer disposed on a surface of the base steel sheet, the Zn—Al—Mg-based coating layer having a metal element composition ratio by mass of Al: 1.0 to 22.0%, Mg: 1.3 to 10.0%, Si: 0 to 2.0%, Ti: 0 to 0.10%, B: 0 to 0.05%, Fe: 2.0% or less, and the balance of Zn and inevitable impurities, the high-strength surface-coated steel sheet having a diffusible hydrogen concentration in the base steel sheet of 0.30 ppm or less and having a time until occurrence of red rust of 7000 hours or more as measured by a neutral salt spray test (salt concentration: 50 g/L, temperature: 35° C., back face and edge face seal of test piece: present) according to JIS Z2371:2015.

The high-strength surface-coated steel sheet has a tensile strength in the direction perpendicular to the rolling direction of, for example, 590 MPa or higher. The Zn—Al—Mg-based coating layer has a mean thickness of, for example, 3 to 100 μm. Among the above high-strength surface-coated steel sheets, a steel sheet having a black appearance with a lightness L' of a coating layer surface of 60 or less is provided as one having improved design properties. Here, L* is a lightness index L* in the CIE 1976 L*a*b* color space. The Zn—Al—Mg-based coating layer may further include an inorganic coating or an organic coating on the surface thereof.

As a method for producing the high-strength surface-coated steel sheet, provided is a method including:

a step of heating a base steel sheet having the above steel composition at 550 to 900° C. in a mixed gas of hydrogen and nitrogen, then immersing the heated steel sheet in a hot-dip plating bath having a composition by mass of Al: 1.0 to 22.0%, Mg: 1.3 to 10.0%, Si: 0 to 2.0%, Ti: 0 to 0.10%, B: 0 to 0.05%, Fe: 2.0% or less, and the balance of Zn and inevitable impurities using hot-dip plating equipment without exposed to the atmosphere to produce a hot-dip Zn—Al—Mg-based-plated steel sheet (hot-dip plating step);

a step of imparting a strain of a total elongation rate of 0.2 to 1.0% to the hot-dip Zn—Al—Mg-based-plated steel sheet using any one or both of a tension leveler and a rolling mill to thereby introduce a crack in a plating layer (crack introducing step); and a step of heating and holding the hot-dip Zn—Al—Mg-based-plated steel sheet having cracks introduced at 70 to 150° C. to thereby decrease a diffusible hydrogen concentration in the base steel sheet to 0.30 ppm or less, and more preferably 0.20 ppm or less (baking treatment step).

As the steel sheet to be subjected to the baking treatment step, a steel sheet that has a diffusible hydrogen concentration in the base steel sheet of 0.35 ppm or more is particularly effectively applied. In addition, when the above baking treatment is conducted by a method in which a plating layer surface is brought into contact with steam by heating and holding the plated steel sheet to 70 to 150° C. in a steam atmosphere, a steel sheet having a black appearance with a lightness L' of 60 or less can be obtained.

Advantageous Effects of Invention

The present invention can provide a surface-treated steel sheet in which hot-dip Zn—Al—Mg-based plating is applied on a high-tensile steel used as a base steel sheet for plating and in which the concentration of hydrogen having entered the steel in a plating line or the like is decreased by a baking treatment. The surface-treated steel sheet has high reliability in the resistance to hydrogen embrittlement. In addition, the inherent excellent corrosion resistance of a hot-dip Zn—Al—Mg-based plating layer is maintained despite application of the baking treatment. Furthermore, it is possible to achieve a black appearance with high design properties by using the baking treatment. The present invention makes it possible to achieve all of the followings together: the high corrosion resistance inherent in a hot-dip Zn—Al—Mg-based-plated steel sheet, the high strength due to a high-tensile steel, the high reliability in resistance to hydrogen embrittlement, and further, if required, the high design properties due to a black-tone surface appearance.

BRIEF DESCRIPTION OF DRAWINGS

FIG. 1 is the SEM photograph of a coating layer surface of a plated steel sheet E-2 having cracks introduced therein.

FIG. 2 is the SEM photograph of a coating layer surface of a plated steel sheet H-2 having cracks introduced therein.

DESCRIPTION OF EMBODIMENTS

Chemical Composition of Base Steel Sheet

The component elements of the base steel sheet corresponding to a base steel sheet for plating will be described. As used herein, the "%" with respect to the chemical composition of a base steel sheet means "% by mass" unless otherwise specified.

C is an essential element for achieving high strength of a steel. A C content of 0.01% or more is required for achieving a strength level of a tensile strength of 590 MPa or higher. With an excess C content, the unevenness in the structure becomes significant to lower the workability. The C content is limited to 0.20% or less and may be controlled to 0.16% or less.

Si is not only effective for achieving high strength but also has an action of suppressing precipitation of cementite and is effective for suppressing generation of perlite or the like. An Si content of 0.01% or more is ensured to substantially exhibit the actions. When a large amount of Si is contained, an Si-concentrated layer may be generated in a steel sheet surface, which becomes a factor of lowering the plating properties. The Si content is limited to 0.50% or less and more preferably to 0.25% or less.

Mn is effective for achieving high strength. An Mn content of 0.10% or more is ensured to stably achieve a strength level of a tensile strength of 590 MPa or higher. An Mn content of 0.50% or more is more effective. With an excess Mn content, segregation is liable to occur to lower the workability. The Mn content is 2.50% or less.

P is effective for solid solution strengthening. Here, a P content of 0.005% or more is ensured. The P content may be controlled to 0.010% or more. With an excess P content, segregation is liable to occur to lower the workability. The P content is limited to 0.050% or less.

B suppresses the austenite-ferrite transformation of a steel and contributes to microstructure transition hardening. In addition, when Ti or Nb is added, B has an effect of decreasing the precipitation temperature of Ti-based carbide or Nb-based carbide by suppressing the austenite-ferrite transformation to reduce the size of the carbides. A B content of 0.0005% or more is ensured to sufficiently achieve the above effects. A B content of 0.001% or more is more effective. A large B content becomes a factor of lowering the workability due to generation of a boride. B, if added, is to be added in the range of 0.010% or less and may be controlled to 0.005% or less.

Ti binds to C to form a fine Ti-based carbide and contributes to achieving high strength. A Ti content of 0.01% or more is ensured to sufficiently exhibit the action. An excess Ti content leads to lower workability. The Ti content is 0.20% or less and may be controlled to 0.15% or less.

Nb binds to C to form a fine Nb-based carbide and contributes to achieving high strength. In addition, Nb is effective for achieving size reduction and evenness of a structure. Accordingly, Nb can be contained as required. It is more effective to ensure a Nb content of 0.005% or more for sufficiently achieving the above effects. A large Nb content leads to lower workability. Nb, if added, is contained in the range of 0.10% or less.

Mo and Cr both have an action of increasing strength by solid solution strengthening. Thus, one or both of Mo and Cr can be added as required. It is more effective to ensure a Mo content of 0.01% or more and a Cr content of 0.01% or more for sufficiently achieving the above action. Large contents of the elements lead to lower ductility. If one or both of the elements are added, the Mo content is in the range of 0.50% or less and the Cr content is in the range of 0.50% or less.

Al has an action of deoxidizing. Al is desirably added in an Al content in the steel of 0.01% or more for sufficiently achieving the action. An excess Al content leads to lower workability. The Al content is limited to 0.10% or less and may be controlled to 0.05% or less.

Besides, S incorporated as impurities is acceptable in a content of 0.010% or less and the content is more preferably 0.005% or less. Since a too low S content leads to an increased load in the steelmaking, the S content may usually be 0.0005% or more.

Zn—Al—Mg-Based Coating Layer

A Zn—Al—Mg-based coating layer has to be present on a surface of a base steel sheet having the above chemical composition. The coating layer is derived from a plating layer which is formed by hot-dip Zn—Al—Mg-based plating. This layer is herein referred to as a "Zn—Al—Mg-based coating layer". As described later, the Zn—Al—Mg-based coating layer has undergone a baking treatment after introduction of cracks. Accordingly, the Zn—Al—Mg-based coating layer after the baking treatment has cracks. When the surface of the Zn—Al—Mg-based coating layer is observed, for example, by SEM (scanning electron microscope), the total extension of the cracks per $mm^2$ is, for example, 3.0 to 8.0 mm. The cracks have contributed to release of hydrogen from the base steel sheet and it is found that even if cracks having a total extension of the above range remain, decrease in the corrosion resistance due to the cracks is not a problem. The temperature in the baking treatment has large influence on whether the inherent excellent corrosion resistance of a hot-dip Zn—Al—Mg-based plating layer is maintained. Since the high-strength surface-coated steel sheet according to the present invention is produced while avoiding baking at a high temperature as described later, the high-strength surface-coated steel sheet has an excellent corrosion resistance such that a time until occurrence of red rust is 7000 hours or more as measured by a neutral salt spray test (salt concentration: 50 g/L, temperature: 35° C., back face and edge face seal of test piece: present) according to JIS Z2371:2015. A steel sheet which includes a black Zn—Al—Mg-based coating layer formed by conducting a baking treatment in a steam atmosphere also has the same excellent corrosion resistance.

Although the Zn—Al—Mg-based coating layer has undergone a baking treatment, the chemical composition substantially maintains the composition of the original hot-dip Zn—Al—Mg-based plating layer. A part of Zn has changed to its black oxide in a black Zn—Al—Mg-based coating layer formed by conducting a baking treatment in a steam atmosphere, but also in this case, the composition of the original hot-dip Zn—Al—Mg-based plating layer is substantially maintained in terms of the metal element composition ratio. As the original hot-dip Zn—Al—Mg-based plating layer, a plating layer having a composition within a composition range applied to a hot-dip Zn—Al—Mg-based-plated steel sheet excellent in corrosion resistance is used herein. Specifically, a plating layer having a metal element composition ratio by mass of Al: 1.0 to 22.0%, Mg: 1.3 to 10.0%, Si: 0 to 2.0%, Ti: 0 to 0.10%, B: 0 to 0.05%, Fe: 2.0% or less, and the balance of Zn and inevitable impurities is a subject herein.

For maintaining the excellent rustproofing effect of a Zn—Al—Mg-based coating layer for a long period of time, the Zn—Al—Mg-based coating layer preferably has a mean thickness of 3 μm or more. Layer formation at a too large thickness is not economical and also leads to lower workability of the coating layer itself. In general, the Zn—Al—Mg-based coating layer may have a mean thickness in the rage of 100 or less. Here, the mean thickness of a coating layer can be determined by observing a cross section parallel to the sheet thickness direction.

A Zn—Al—Mg-based coating layer having a black appearance is formed by a surface of the hot-dip Zn—Al—Mg-based plating layer which is brought into contact with steam during a baking treatment to generate a black oxide of Zn in the coating layer. Accordingly, the black oxide of Zn is relatively largely distributed in an upper layer portion of the Zn—Al—Mg-based coating layer to provide an effect of giving a black-tone surface appearance. As a result of various studies, it has been found that when the black oxide of Zn is formed so that the lightness L* of the surface of the Zn—Al—Mg-based coating layer is 60 or less, a black appearance which is excellent in design properties with hardly noticeable uneven discoloration is provided. When the lightness L* is controlled to 40 or less, a deeper black appearance is provided. The black appearance due to the black oxide of Zn can be achieved within such a condition range of a baking treatment that the in-steel diffusible hydrogen concentration is decreased to 0.30 ppm or less.

Diffusible Hydrogen Concentration in Base Steel Sheet

The hydrogen concentration of a base steel sheet which becomes a factor of hydrogen embrittlement can be evaluated by measuring the diffusible hydrogen concentration. The diffusible hydrogen concentration can be determined by measuring the amount of hydrogen released when the steel sheet is heated from a room temperature to 300° C. at a temperature-rising rate of 5° C./min in an atmospheric pressure ionization mass spectrometer. As a measurement sample, a sample composed only of a base steel sheet obtained by removing a Zn—Al—Mg-based coating layer with abrasive paper can be used.

In general, in the case of a hot-dip Zn—Al—Mg-based-plated steel sheet that is produced using a high-tensile steel within the above composition range as a base steel sheet for plating in a continuous hot-dip plating line, the diffusible hydrogen concentration of the base steel sheet before a baking treatment is 0.35 ppm or more. According to a study by the present inventors, it has been found that when the diffusible hydrogen concentration of a base steel sheet is lowered to 0.30 ppm or less by a baking treatment, not only a hydrogen embrittlement phenomenon that is often a problem in a hot-dip Zn—Al—Mg-based-plated steel sheet including a high-tensile steel of 980-MPa or higher grade as a base steel sheet, but also a hydrogen embrittlement phenomenon in a hot-dip Zn—Al—Mg-based-plated steel sheet including a high-tensile steel of 780-MPa grade or 590-MPa grade, which is a relatively lower strength level, as a base steel sheet is significantly suppressed. Accordingly, in the present invention, the diffusible hydrogen concentration in the base steel sheet is defined to 0.30 ppm or less. The diffusible hydrogen concentration is more preferably 0.20 ppm or less.

Metal Structure of Base Steel Sheet

The matrix (steel base) of a base steel sheet is desirably a structure of a bainitic ferrite phase or a mixed structure of a ferritic phase and a martensitic phase. In the latter structure, the amount of martensite is preferably 10 to 50% by volume.

Mechanical Properties

Regarding the mechanical properties of the black surface-coated high-strength steel sheet having the Zn—Al—Mg-based coating layer formed, it is desired that the tensile strength be 590 to 1180 MPa and the total elongation at break be 10% or more in a tensile test (JIS Z2241:2011) in the direction perpendicular to the rolling direction.

Production Method

A high-strength surface-coated steel sheet having a diffusible hydrogen concentration in a base steel sheet lowered as described above can be produced by producing a hot-dip Zn—Al—Mg-based-plated steel sheet using a steel sheet having the above chemical composition as a base steel sheet for plating, introducing cracks in the plating layer of the plated steel sheet, and then applying a baking treatment in a temperature range controlled to a relatively low level.

Hot-Dip Plating

The hot-dip Zn—Al—Mg-based-plated steel sheet may be produced by a conventionally known method. A continuous hot-dip plating line in a site of mass production can be used. Specifically, a heat treatment which is applied immediately before hot-dip plating and which also functions as a surface reduction treatment is conducted by heating at 550 to 900° C. in a mixed gas of hydrogen and nitrogen. The proportion of hydrogen gas in the mixed gas is desirably 25 to 35% by volume. The time period where the material temperature is kept in the above temperature range is desirably adjusted in the range of 20 to 200 seconds. When a base steel sheet is heated in a mixed gas of hydrogen and nitrogen in this manner, hydrogen enters the steel. The in-steel concentration of hydrogen can be considerably decreased by a baking treatment as described later. The thickness of the base steel sheet is, for example, 0.8 to 4.5 mm. After the heat treatment, the steel sheet is immersed in a hot-dip plating bath without exposed to the atmosphere.

The composition of the hot-dip plating bath by mass is Al: 1.0 to 22.0%, Mg: 1.3 to 10.0%, Si: 0 to 2.0%, Ti: 0 to 0.10%, B: 0 to 0.05%, Fe: 2.0% or less, and the balance of Zn and inevitable impurities. The plating layer composition of the resulting plated steel sheet almost reflects the plating bath composition. The steel sheet taken out of the plating bath is cooled by an ordinary method after adjusting the amount of deposited plating by a gas wiping method or the like. The amount of deposited plating is preferably 3 to 100 μm in teams of a plating layer mean thickness on one face.

Crack Introducing Treatment

For preventing degradation of the inherent excellent corrosion resistance of a hot-dip Zn—Al—Mg-based plating layer by a baking treatment, the baking treatment is required to be applied in a low temperature range as described later. However, it has been found that a hot-dip Zn—Al—Mg-based plating layer is liable to interfere with hydrogen release as compared with a general galvanizing layer. For this reason, when a baking treatment in a low temperature range is applied on a hot-dip Zn—Al—Mg-based-plated steel sheet, it is difficult to stably decrease hydrogen in the base steel sheet to a certain concentration or lower. Thus, as a pretreatment for the baking treatment, cracks are introduced into the plating layer. Even in a Zn—Al—Mg-based coating layer having cracks introduced, a rustproofing effect is exhibited by a corrosion product inherent in a hot-dip Zn—Al—Mg-based plating layer when used under an environment exposed to rain water or a wet environment.

The introduction of cracks into a plating layer can be achieved by bending-stretching deformation with a tension leveler or a skin pass rolling. The deformation by a tension leveler or a skin pass roller may be applied several times in total. As a result of various studies, a strain of a total elongation rate of 0.2 to 1.0% is desirably applied on a steel sheet. In this range of the total elongation rate, cracks having a total extension of 3.0 to 8.0 mm, more preferably 3.0 to 6.0 mm per $mm^2$ are introduced in a plating layer surface, and the diffusible hydrogen concentration in the base steel sheet can be lowered to 0.30 ppm or less, more preferably 0.20 ppm or less by a baking treatment in a low temperature range as described later. With a too low total elongation rate, the amount of cracks introduced is short and the effect of sufficiently releasing hydrogen by a baking treatment in a low temperature range cannot be stably obtained. A too high total elongation rate becomes a factor of impairing the ductility of the steel sheet.

The total elongation rate $R_{TOTAL}$ (%) is determined by the following formula (1):

$$R_{TOTAL}(\%)=(L_1-L_0)/L_0\times 100 \quad (1)$$

wherein $L_0$ is the sheet direction length (m) of an arbitrary sheet direction section X in a steel sheet at the time point when hot-dip Zn—Al—Mg-based plating is completed and $L_1$ is the sheet direction length (m) of the sheet direction section X-derived section in the steel sheet immediately before the start of a baking treatment.

Baking Treatment

A baking treatment is a heat treatment for decreasing the in-steel hydrogen concentration by releasing hydrogen having entered a steel material to the outside thereof. When a black-tone surface appearance is to be obtained, the baking treatment also functions as a blackening treatment therefor. The present inventors have made studies on a relationship between the heating temperature (maximum temperature the material reaches) in a baking treatment and the corrosion resistance. As a result, when a hot-dip Zn—Al—Mg-based plating layer having the above composition is heated to a temperature higher than 150° C., the phase structure in the plating layer changes and degradation in corrosion resistance becomes apparent. On the other hand, with a heat temperature of a baking treatment lower than 70° C., it is difficult to sufficiently obtain the effect of releasing hydrogen in a stable manner. Accordingly, the baking treatment is conducted by heating and holding at 70 to 150° C.

The time period of the baking treatment, that is, the time period where a hot-dip Zn—Al—Mg-based-plated steel sheet is held at a prescribed temperature which is set in the range of 70 to 150° C. is set to be such a time period that the diffusible hydrogen concentration in the base steel sheet can be decreased to a target level of 0.30 ppm or less or 0.20 ppm or less. An appropriate treatment time may be set by performing a pretest according to the hot-dip plating conditions, the atmospheric gas conditions of the baking treatment, and the baking treatment temperature. In general, a treatment time for achieving a good result can be set in the range of 1 to 50 hours, and is preferably in the range of 2 to 36 hours.

The heating atmosphere of the baking treatment is required to be a steam atmosphere when a black-tone surface appearance is to be obtained, but in the other cases, the heating atmosphere may be any atmosphere, such as an air, a vacuum, or an inert gas atmosphere. When blackening is performed under a steam atmosphere, the content of impurity gas components (gas components other than steam) in the steam atmosphere is desirably 5% by volume or less.

When a hot-dip Zn—Al—Mg-based plating layer is brought into contact with steam at the above temperature, Zn in the plating layer is prominently oxidized to form a black Zn oxide, whereby a black-tone surface appearance having high design properties with a lightness L* of 60 or less can be obtained. The partial pressure of steam is adjusted so that the relative humidity (the partial pressure of steam actually present in the atmosphere to the saturated steam pressure in the temperature) is 70 to 100%. With a relative humidity lower than 70%, the generation rate of the black oxide of Zn is low and uneven discoloration is liable to occur in such a time period that the release of hydrogen in the steel is sufficiently achieved.

When the baking treatment is conducted under the air atmosphere, a technique of allowing a sheet to pass through a continuous annealing furnace can be applied. When a steel sheet coiled into a coil is subjected to a baking treatment, for example, a bell-type batch annealing furnace can be used. In this case, it is possible to perform a treatment under a prescribed atmosphere other than the air atmosphere.

When blackening is applied in a steam atmosphere, the treatment is conducted in a furnace insulated from the air atmosphere. An airtightly closed container is desirably used as a furnace body. When a hot-dip Zn—Al—Mg-based-plated steel sheet is contained in a furnace, the steel sheet is placed so that the plating layer surface is in contact with the atmospheric gas. After purging the air in the furnace by nitrogen purge, evacuation, or the like, steam is introduced to convert the atmosphere in the furnace into a steam atmosphere and the temperature is elevated and kept at a prescribed temperature, thereby conducting a baking treatment. The atmosphere in the furnace is controlled so that a prescribed gas composition is maintained during the baking treatment.

Formation of Inorganic Coating

An inorganic coating can be formed on a surface of a Zn—Al—Mg-based coating layer modified by the baking treatment described above. As the inorganic coating, known various coatings that have conventionally been applied to a hot-dip Zn—Al—Mg-based-plated steel sheet can be applied. Among them, an inorganic coating that contains one or two or more compounds selected from the group consisting of oxides of valve metals, oxoates of valve metals, hydroxides of valve metals, phosphates of valve metals, and fluorides of valve metals (hereinafter also referred to as "valve metal compounds") can be mentioned as suitable examples. Examples of valve metals include Ti, Zr, Hf, V, Nb, Ta, W, Si, and Al. A valve metal compound containing one or more of the above valve metals is desirably applied as the valve metal compound. An inorganic coating can be formed by a known method. For example, a method in which an inorganic paint containing a valve metal compound and other components is applied on a surface of a Zn—Al—Mg-based coating layer by a roll coating method, a spin coating method, a spraying method, or the like can be adopted.

Formation of Organic Coating

An organic coating can also be formed on a surface of a Zn—Al—Mg-based coating layer modified by the baking treatment described above. Various known organic resin coatings which has conventionally been applied on a hot-dip Zn—Al—Mg-based-plated steel sheet can similarly be applied. Examples thereof include coatings containing a urethan resin, an epoxy resin, an olefin resin, a styrene resin, a polyester resin, an acrylic resin, a fluororesin, or a combination of the above resins, or a copolymer or a modified product of the above resins. An organic coating can similarly be formed by a known method. For example, a method in which an organic paint containing the above resin component is applied on a surface of a Zn—Al—Mg-based coating layer by a roll coating method, a spin coating method, a spraying method, or the like can be adopted.

EXAMPLES

A cast slab having each chemical composition shown in Table 1 was heated to 1250° C. and then was subjected to hot rolling to produce a hot rolled steel sheet for a hot rolled base steel sheet for plating or for a cold rolled base steel sheet for plating. The conditions for hot rolling are, for the hot rolled base steel sheet for plating a finish rolling temperature of 880° C., a coiling temperature of 600° C., and a sheet thickness of 3.2 mm, and for the cold rolled base steel sheet for plating, a finish rolling temperature of 880° C., a coiling temperature of 460° C., and a sheet thickness of 2 mm. Here, the finish rolling temperature is represented by the sheet surface temperature immediately after the last pass of the hot rolling. The hot rolled steel sheet for a hot rolled base steel sheet for plating was subjected to acid cleaning and then was used as a hot rolled base steel sheet for plating as it was. The hot rolled steel sheet for a cold rolled base steel sheet for plating was subjected to acid cleaning and then was subjected to cold rolling at each cold rolling ratio shown in Table 2 to thereby obtain a cold rolled base steel sheet for plating.

Note that all the steels shown in Table 1 are the "Inventive steels" which meet the chemical composition defined in the present invention. The steels in Table 2 having a cold rolling ratio of 0% are examples in which a hot rolled base steel sheet for plating was used.

TABLE 1

| | Chemical composition (% by mass) | | | | | | | | |
|---|---|---|---|---|---|---|---|---|---|
| Steel No. | C | Si | Mn | P | S | Al | B | Ti | Others |
| A | 0.026 | 0.04 | 0.70 | 0.020 | 0.003 | 0.040 | 0.0028 | 0.070 | — |
| B | 0.024 | 0.05 | 1.00 | 0.020 | 0.003 | 0.040 | 0.0031 | 0.069 | — |
| C | 0.047 | 0.04 | 1.20 | 0.018 | 0.002 | 0.038 | 0.0035 | 0.113 | — |
| D | 0.112 | 0.03 | 2.00 | 0.020 | 0.003 | 0.040 | 0.0030 | 0.030 | — |
| E | 0.151 | 0.20 | 2.20 | 0.023 | 0.003 | 0.043 | 0.0030 | 0.032 | — |
| F | 0.101 | 0.08 | 1.80 | 0.018 | 0.004 | 0.038 | 0.0028 | 0.030 | Nb: 0.020 |
| G | 0.120 | 0.10 | 1.70 | 0.022 | 0.003 | 0.042 | 0.0040 | 0.029 | Mo: 0.10 |
| H | 0.080 | 0.05 | 1.50 | 0.017 | 0.003 | 0.038 | 0.0030 | 0.032 | — |
| I | 0.123 | 0.05 | 2.04 | 0.018 | 0.002 | 0.042 | 0.0030 | 0.035 | Cr: 0.40 |

Hot-Dip Plating Step

A hot-dip Zn—Al—Mg-based-plated steel sheet was produced using each base steel sheet for plating in a continuous hot-dip plating line. A base steel sheet for plating (base steel sheet) was heated in a mixed gas of hydrogen and nitrogen to anneal the sheet, then immersing the sheet in a hot-dip plating bath without exposed to the air atmosphere, then taking out the sheet from the plating bath, and adjusting the amount of deposited plating by a gas wiping method, thereby obtaining a hot-dip Zn—Al—Mg-based-plated steel sheet. The composition of the plating bath by mass was Al: 6.0%, Mg: 3.0%, Si: 0.01%, Ti: 0.002%, B: 0.0005%, Fe: 0.1%, and the balance of Zn. The atmosphere and temperature in the annealing are shown in Table 2. The amount of deposited plating was adjusted so that the plating layer thickness of one face of the steel sheet was 10 μm.

Crack Introducing Step

The continuous hot-dip plating line used includes a tension leveler (T.Lv) and a skin pass roller (SKP) in a stage after a plating apparatus (on the downstream side in the sheet direction). In a steel strip in which the hot-dip plating is finished, the following portions were formed:

(i) a portion in which no elongation deformation was applied with the tension leveler nor the skin pass roller;

(ii) a portion in which an elongation deformation of a total elongation rate of 0.2 to 1.0% was applied with any one or both of the tension leveler and the skin pass roller; and (iii) a portion in which an elongation deformation of a total elongation rate of 1.2% was applied with both of the tension leveler and the skin pass roller.

From a coil of the resulting hot-dip Zn—Al—Mg-based-plated steel sheet, plated steel sheets of the portions of the above (i) to (iii) were sampled and the metal structures of cross sections of directions parallel to the rolling direction and the sheet thickness direction (L cross sections) were observed with an optical microscope. In addition, a tensile test piece (JIS No. 5) in the direction perpendicular to the rolling direction was prepared and was subjected to a tensile test as defined in JIS Z2241:2011 to determine the tensile strength TS (MPa) and the total elongation at break T.E1 (%). Furthermore, for the plated steel sheets of the portions of the above (ii) and (iii), the surface of the coating layer (plating layer) was observed in 10 viewing areas at 500-fold magnification by SEM to measure the lengths of cracks formed in the coating layer surface and the total extension (mm) of cracks per $mm^2$ area was determined. For a reference, FIG. 1 and FIG. 2 respectively show the SEM photograph of the coating layer surfaces of the plated steel sheet E-2 of Table 2 (total elongation rate in crack introducing step: 0.2%, crack total extension per $mm^2$ coating layer: 3.2 mm) and the plated steel sheet H-2 of Table 2 (total elongation rate in crack introducing step: 1.0%, crack total extension per $mm^2$ coating layer: 6.8 mm). In both of FIG. 1 and FIG. 2, (a) shows an example of the SEM image and (b) shows the SEM image in which cracks that are obviously ones introduced by the crack introducing step are indicated by black lines. It has been found that most of the cracks remained as they are after a baking treatment described later. The total extension of cracks per $mm^2$ area in each plated steel sheet was determined by measuring the total extension of the cracks that are obviously ones introduced in the crack introducing step. Table 2 shows the results.

TABLE 2

| Steel No. | Plated steel sheet No. | Hot rolling coiling temperature (° C.) | Cold rolling ratio (%) | Hot-dip plating line: Annealing atmosphere | Hot-dip plating line: Annealing temperature (° C.) | Crack introducing step: T.Lv | Crack introducing step: SKP | Crack introducing step: Total elongation (%) | Hot-dip plated steel sheet (before baking treatment): Sheet thickness (mm) | Hot-dip plated steel sheet (before baking treatment): Metal structure of base*1 | Hot-dip plated steel sheet (before baking treatment): TS (MPa) | Hot-dip plated steel sheet (before baking treatment): T.El (%) | Hot-dip plated steel sheet (before baking treatment): Crack total extension in coating layer ($mm^{-1}$) | Classification |
|---|---|---|---|---|---|---|---|---|---|---|---|---|---|---|
| A | A-1 | 600 | 0 | $N_2$ + | 680 | No | No | 0 | 3.2 | BF | 615 | 21 | 0 | Comp. material |
| | A-2 | | | 30% $H_2$ | | No | Yes | 0.2 | | | 620 | 21 | 3.6 | Inv. material |
| | A-3 | | | | | Yes | Yes | 1.2 | | | 625 | 18 | 8.7 | Comp. material |
| B | B-1 | 600 | 0 | $N_2$ + | 680 | No | No | 0 | 3.2 | BF | 665 | 20 | 0 | Comp. material |
| | B-2 | | | 30% $H_2$ | | No | Yes | 0.5 | | | 680 | 20 | 4.2 | Inv. material |
| | B-3 | | | | | Yes | Yes | 1.2 | | | 691 | 17 | 8.5 | Comp. material |
| C | C-1 | 600 | 2 | $N_2$ + | 680 | No | No | 0 | 3.2 | BF | 821 | 20 | 0 | Comp. material |
| | C-2 | | | 30% $H_2$ | | No | Yes | 0.8 | | | 830 | 19 | 4.9 | Inv. material |
| | C-3 | | | | | Yes | Yes | 1.2 | | | 840 | 17 | 8.6 | Comp. material |
| D | D-1 | 460 | 50 | $N_2$ + | 800 | No | No | 0 | 1.0 | F + M | 807 | 24 | 0 | Comp. material |
| | D-2 | | | 30% $H_2$ | | Yes | No | 0.2 | | | 810 | 24 | 3.4 | Inv. material |
| | D-3 | | | | | Yes | Yes | 1.2 | | | 822 | 21 | 8.6 | Comp. material |
| E | E-1 | 460 | 50 | $N_2$ + | 800 | No | No | 0 | 1.0 | F + M | 1015 | 16 | 0 | Comp. material |
| | E-2 | | | 30% $H_2$ | | Yes | Yes | 0.2 | | | 1020 | 15 | 3.2 | Inv. material |
| | E-3 | | | | | Yes | Yes | 1.2 | | | 1036 | 13 | 8.8 | Comp. material |
| F | F-1 | 460 | 50 | $N_2$ + | 800 | No | No | 0 | 1.0 | F + M | 790 | 22 | 0 | Comp. material |
| | F-2 | | | 30% $H_2$ | | Yes | Yes | 0.5 | | | 798 | 21 | 4.1 | Inv. material |
| | F-3 | | | | | Yes | Yes | 1.2 | | | 815 | 19 | 8.8 | Comp. material |
| G | G-1 | 460 | 50 | $N_2$ + | 800 | No | No | 0 | 1.0 | F + M | 547 | 23 | 0 | Comp. material |
| | G-2 | | | 30% $H_2$ | | Yes | Yes | 0.7 | | | 855 | 23 | 4.6 | Inv. material |
| | G-3 | | | | | Yes | Yes | 1.2 | | | 863 | 19 | 8.7 | Comp. material |
| H | H-1 | 460 | 50 | $N_2$ + | 800 | No | No | 0 | 1.0 | F + M | 629 | 31 | 0 | Comp. material |
| | H-2 | | | 30% $H_2$ | | Yes | Yes | 1.0 | | | 645 | 30 | 5.4 | Inv. material |
| | H-3 | | | | | Yes | Yes | 1.2 | | | 650 | 27 | 8.7 | Comp. material |
| I | I-1 | 460 | 50 | $N_2$ + | 800 | No | No | 0 | 1.0 | F + M | 998 | 15 | 0 | Comp. material |
| | I-2 | | | 30% $H_2$ | | Yes | Yes | 0.4 | | | 1005 | 14 | 4.0 | Inv. material |
| | I-3 | | | | | Yes | Yes | 1.2 | | | 1023 | 13 | 8.5 | Comp. material |

*1BF: bainitic ferrite, F: ferrite, M: martensite/hatching: outside the production conditions of the present invention As can be seen in Table 2, by imparting an elongation deformation of a total elongation rate of 0.2% or more in a crack introducing step, cracks having a total extension per $mm^2$ of 3.0 mm or more can be introduced into a coating layer (plating layer). When an elongation deformation of a total elongation rate of 1.2% is imparted, the total elongation at break T.E1 was lower and the ductility of the steel sheet was lowered as compared with the case of a total elongation rate of 0.2 to 1.0%. When the workability of the steel sheet is emphasized, the total elongation rate in the crack introducing step is desirably set to a value in the range of 1.0% or less.

Baking Treatment Step

Next, using plated steel sheets of a portion of the above (i) (with no crack introduced) and a portion of (ii) (with cracks introduced), effects of a baking treatment were investigated. The conditions of the baking treatment are shown in Tables 3 to 5. A baking treatment were applied under the air atmosphere (Table 3) for the plated steel sheet of portion (i), and under the air atmosphere (Table 4) and a steam atmosphere (Table 5) for the plated steel sheet of portion (ii). Among them, the baking treatment under a steam atmosphere was performed as follows. That is, a plated steel sheet after a crack introducing step was placed in a heating furnace so that the plating layer surface was in contact with the atmospheric gas. Subsequently, the furnace was airtightly closed and was subjected to evacuation with a vacuum pump, and steam was introduced from a gas inlet tube. Then, the temperature in the furnace was increased to a prescribed baking treatment temperature while controlling the pressure in the furnace so that the relative humidity is 100%. The temperature was kept for a prescribed time period and then was decreased and the inside of the furnace was released to the atmosphere. The atmospheric gas during the baking treatment was 100% by volume of steam and the relative humidity was 100% (the same applies to all the examples in Table 5).

A sample was taken from the steel sheet after the baking treatment, and the diffusible hydrogen concentration in the base steel sheet and the time until occurrence of red rust by a salt spray test were measured. In addition, for the steel sheets having subjected to a baking treatment under a steam atmosphere (ones described in Table 5), the lightness L* of the Zn—Al—Mg-based coating layer surface was measured. The test method is as follows.

(Measurement of Diffusible Hydrogen Concentration)

The Zn—Al—Mg-based coating layer which is a surface layer of the steel sheet sample was removed with abrasive paper to produce a sample composed only of the base steel sheet. The measurement conditions of the diffusible hydrogen concentration are shown below.

Sample heater: infrared gold image furnace (RHL-E410P manufactured by ULVAC-RIKO, Inc.)

Analyzer: APS-MS/atmospheric pressure ionization mass spectrometer (FLEX-MS400 manufactured by NIPPON API Co., Ltd.)

Analysis sample: three sheets cut into a size of 10 mm×3 mm

Measurement temperature: room temperature to 300° C.

Temperature rising rate: 5° C./rain

Measurement atmosphere: Ar (1000 mL/min)

Measurement of Time Until Occurrence of Red Rust by Salt Spray Test

A neutral salt spray test according to JIS Z2371:2015 (salt concentration: 50 g/L, temperature: 35° C., back face and edge face seal of test piece: present) was conducted. Spray was stopped every 100 hours after 4000 hours elapsed from the start of the salt spray test and the occurrence of red rust on the test piece surface was visually observed. The accumulated time of spray of a salt solution at the time when the occurrence of red rust was first recognized was taken as a time until occurrence of red rust of the sample. Since the observation was performed every 100 hours here, for example, a sample having a time until occurrence of red rust of 7100 hours can be evaluated as at least meeting the corrosion resistance requirement: "the time until occurrence of red rust is 7000 hours or more".

Measurement of Lightness L* Value

The lightness L* value was measured using a spectral color difference meter (TC-1800 manufactured by Tokyo Denshoku Co. Ltd.) by a spectral reflectance measuring method according to JIS K5600. The measurement conditions are shown below.

Optical conditions: d/8° method (double beam optical system)

Angular size: 2 degrees Measuring method: reflected light measurement

Standard light: C

Color system: CIELAB

Measurement wavelengths: 380 to 780 nm

Interval of measurement wavelengths: 5 nm

Spectroscope: diffraction grating 1200/mm

Illumination: halogen lamp (voltage: 12 V, power: 50 W, rated life: 2000 hours)

Measured area: 7.25 mmφ

Detecting element: photomultiplier tube (R928; Hamamatsu Photonics K. K.)

Reflectance: 0-150%

Measurement temperature: 23° C.

Reference sheet: white

The results are shown in Tables 3, 4, and 5.

TABLE 3

| Sample No. | Plated steel sheet No. | Crack introducing step Total elongation (%) | Baking treatment step Atmosphere | Temperature (° C.) | Time (h) | Zn—Al—Mg-based-coated steel sheet Diffusible hydrogen concentration in base steel sheet (ppm) | Time until occurrence of red rust in salt spray test (h) | Classification |
|---|---|---|---|---|---|---|---|---|
| 1 | A-1 | 0 | Air | 110 | 24 | 0.34 | 7800 | Comp. Ex. |
| 2 | B-1 | 0 | Air | 110 | 24 | 0.35 | 7800 | Comp. Ex. |
| 3 | C-1 | 0 | Air | 110 | 24 | 0.33 | 7800 | Comp. Ex. |
| 4 | | | Air | 140 | 8 | 0.32 | 7300 | Comp. Ex. |
| 5 | | | Air | 80 | 12 | 0.36 | 7800 | Comp. Ex. |
| 6 | | | Air | 80 | 1 | 0.38 | 7800 | Comp. Ex. |
| 7 | | | Air | 80 | 4 | 0.37 | 7800 | Comp. Ex. |
| 8 | | | Air | 80 | 24 | 0.33 | 7800 | Comp. Ex. |
| 9 | | | Air | 50 | 36 | 0.38 | 7800 | Comp. Ex. |
| 10 | D-1 | 0 | Air | 110 | 24 | 0.35 | 7800 | Comp. Ex. |
| 11 | E-1 | 0 | Air | 110 | 24 | 0.35 | 7800 | Comp. Ex. |
| 12 | | | Air | 140 | 8 | 0.31 | 7200 | Comp. Ex. |
| 13 | | | Air | 110 | 4 | 0.37 | 7800 | Comp. Ex. |
| 14 | | | Air | 110 | 12 | 0.36 | 7800 | Comp. Ex. |

TABLE 3-continued

| Sample No. | Plated steel sheet No. | Crack introducing step Total elongation (%) | Baking treatment step Atmosphere | Temperature (° C.) | Time (h) | Zn—Al—Mg-based-coated steel sheet Diffusible hydrogen concentration in base steel sheet (ppm) | Time until occurrence of red rust in salt spray test (h) | Classification |
|---|---|---|---|---|---|---|---|---|
| 15 | F-1 | 0 | Air | 110 | 24 | 0.33 | 7800 | Comp. Ex. |
| 16 | G-1 | 0 | Air | 110 | 24 | 0.33 | 7800 | Comp. Ex. |
| 17 | | | Air | 170 | 4 | 0.30 | 6200 | Comp. Ex. |
| 18 | | | Air | 200 | 4 | 0.18 | 5400 | Comp. Ex. |
| 19 | | | Air | 110 | 8 | 0.34 | 7800 | Comp. Ex. |
| 20 | H-1 | 0 | Air | 110 | 24 | 0.33 | 7800 | Comp. Ex. |
| 21 | | | Air | 110 | 8 | 0.36 | 7800 | Comp. Ex. |
| 22 | I-1 | 0 | Air | 110 | 24 | 0.32 | 7800 | Comp. Ex |
| 23 | | | Air | 140 | 24 | 0.31 | 7400 | Comp. Ex. |
| 24 | | | Air | 200 | 36 | 0.08 | 5000 | Comp. Ex. |
| 25 | | | Air | 80 | 4 | 0.35 | 7800 | Comp. Ex. |
| 26 | | | Air | 80 | 12 | 0.36 | 7800 | Comp. Ex. |
| 27 | | | Air | 80 | 24 | 0.35 | 7800 | Comp. Ex. |
| 28 | | | Air | 110 | 1 | 0.33 | 7800 | Comp. Ex. |

Hatching: inadequate production conditions/underlined: outside the range defined as the Inventive material

TABLE 4

| Sample No. | Plated steel sheet No. | Crack introducing step Total elongation (%) | Baking treatment step Atmosphere | Temperature (° C.) | Time (h) | Zn—Al—Mg-based-coated steel sheet Diffusible hydrogen concentration in base steel sheet (ppm) | Time until occurrence of red rust in salt spray test (h) | Classification |
|---|---|---|---|---|---|---|---|---|
| 31 | A-2 | 0.2 | Air | 110 | 24 | 0.03 | 7800 | Inv. Ex |
| 32 | B-2 | 0.5 | Air | 110 | 24 | 0.04 | 7800 | Inv. Ex. |
| 33 | C-2 | 0.8 | Air | 110 | 24 | 0.05 | 7800 | Inv. Ex. |
| 34 | | | Air | 140 | 8 | 0.09 | 7300 | Inv. Ex. |
| 35 | | | Air | 80 | 12 | 0.16 | 7800 | Inv. Ex. |
| 36 | | | Air | 80 | 1 | 0.29 | 7800 | Inv. Ex. |
| 37 | | | Air | 80 | 4 | 0.27 | 7800 | Inv. Ex. |
| 38 | | | Air | 80 | 24 | 0.14 | 7800 | Inv. Ex. |
| 39 | | | Air | 50 | 36 | 0.35 | 7800 | Comp. Ex. |
| 40 | D-2 | 0.2 | Air | 110 | 24 | 0.09 | 7800 | Inv. Ex. |
| 41 | E-2 | 0.2 | Air | 110 | 24 | 0.10 | 7800 | Inv. Ex. |
| 42 | | | Air | 140 | 8 | 0.07 | 7200 | Inv. Ex. |
| 43 | | | Air | 110 | 4 | 0.09 | 7800 | Inv. Ex. |
| 44 | | | Air | 110 | 12 | 0.09 | 7800 | Inv. Ex. |
| 45 | F-2 | 0.5 | Air | 110 | 24 | 0.10 | 7800 | Inv. Ex. |
| 46 | G-2 | 0.7 | Air | 110 | 24 | 0.07 | 7800 | Inv. Ex. |
| 47 | | | Air | 170 | 4 | 0.05 | 6200 | Comp. Ex. |
| 48 | | | Air | 200 | 4 | 0.02 | 5400 | Comp. Ex. |
| 49 | | | Air | 110 | 8 | 0.08 | 7800 | Inv. Ex. |
| 50 | H-2 | 1.0 | Air | 110 | 24 | 0.03 | 7800 | Inv. Ex. |
| 51 | | | Air | 110 | 8 | 0.06 | 7800 | Inv. Ex. |
| 52 | I-2 | 0.4 | Air | 110 | 24 | 0.04 | 7800 | Inv. Ex. |
| 53 | | | Air | 140 | 24 | 0.03 | 7400 | Inv. Ex. |
| 54 | | | Air | 200 | 36 | 0.02 | 5000 | Comp. Ex. |
| 55 | | | Air | 80 | 4 | 0.28 | 7800 | Inv. Ex. |
| 56 | | | Air | 80 | 12 | 0.14 | 7800 | Inv. Ex. |
| 57 | | | Air | 80 | 24 | 0.13 | 7800 | Inv. Ex. |
| 58 | | | Air | 110 | 1 | 0.25 | 7800 | Inv. Ex. |

Hatching: inadequate production conditions/underlined: outside the range defined as the Inventive material

TABLE 5

| Sample No | Plated steel sheet No. | Crack introducing step Total elongation (%) | Baking treatment step Atmosphere | Baking treatment step Temperature (° C.) | Baking treatment step Time (h) | Zn—Al—Mg-based-coated steel sheet Diffusible hydrogen concentration in base steel sheet (ppm) | Zn—Al—Mg-based-coated steel sheet Time until occurrence of red rust in salt spray test (h) | Zn—Al—Mg-based-coated steel sheet Surface lightness L* | Classification |
|---|---|---|---|---|---|---|---|---|---|
| 61 | A-2 | 0.2 | Steam | 110 | 24 | 0.03 | 7500 | 34 | Inv. Ex. |
| 62 | B-2 | 0.5 | Steam | 110 | 24 | 0.05 | 7500 | 33 | Inv. Ex. |
| 63 | C-2 | 0.8 | Steam | 110 | 24 | 0.06 | 7500 | 34 | Inv. Ex. |
| 64 | | | Steam | 140 | 8 | 0.10 | 7100 | 33 | Inv. Ex. |
| 65 | | | Steam | 80 | 12 | 0.15 | 7500 | 44 | Inv. Ex. |
| 66 | | | Steam | 80 | 1 | 0.30 | 7500 | 48 | Inv. Ex |
| 67 | | | Steam | 80 | 4 | 0.29 | 7500 | 46 | Inv. Ex |
| 63 | | | Steam | 80 | 31 | 0.14 | 7500 | 42 | Inv. Ex |
| 69 | | | Steam | 50 | 36 | 0.38 | 7700 | 65 | Comp. Ex. |
| 70 | D-2 | 0.2 | Steam | 110 | 24 | 0.09 | 7500 | 33 | Inv. Ex |
| 71 | E-2 | 0.2 | Steam | 110 | 24 | 0.11 | 7500 | 34 | Inv. Ex |
| 72 | | | Steam | 140 | 8 | 0.07 | 7100 | 32 | Inv. Ex |
| 73 | | | Steam | 110 | 4 | 0.10 | 7500 | 43 | Inv. Ex. |
| 74 | | | Steam | 110 | 12 | 0.09 | 7500 | 33 | Inv. Ex |
| 75 | F-2 | 0.5 | Steam | 110 | 24 | 0.10 | 7500 | 34 | Inv. Ex |
| 76 | G-2 | 0.7 | Steam | 110 | 24 | 0.09 | 7500 | 35 | Inv. Ex. |
| 77 | | | Steam | 170 | 4 | 0.07 | 6000 | 34 | Comp. Ex |
| 78 | | | Steam | 200 | 4 | 0.03 | 5200 | 32 | Comp. Ex. |
| 79 | | | Steam | 110 | 8 | 0.09 | 7500 | 34 | Inv. Ex. |
| 80 | H-2 | 1.0 | Steam | 110 | 24 | 0.03 | 7500 | 31 | Inv. Ex |
| 81 | | | Steam | 110 | 8 | 0.06 | 7500 | 33 | Inv. Ex. |
| 82 | I-2 | 0.4 | Steam | 110 | 24 | 0.05 | 7500 | 33 | Inv. Ex |
| 83 | | | Steam | 140 | 24 | 0.02 | 7300 | 32 | Inv. Ex |
| 84 | | | Steam | 200 | 36 | 0.02 | 4800 | 33 | Comp. Ex. |
| 85 | | | Steam | 80 | 4 | 0.29 | 7500 | 46 | Inv. Ex |
| 86 | | | Steam | 80 | 12 | 0.15 | 7500 | 45 | Inv. Ex |
| 87 | | | Steam | 80 | 24 | 0.15 | 7500 | 44 | Inv. Ex |
| 88 | | | Steam | 110 | 1 | 0.28 | 7500 | 42 | Inv. Ex |

Hatching: inadequate production conditions/underlined: outside the range defined as the Inventive material When a baking treatment was applied without introducing cracks into a plating layer (Table 3), except for examples in which a baking treatment was applied at an elevated temperature higher than 150° C. (sample Nos. 17, 18, and 24), the diffusible hydrogen concentration in the base steel sheet was not able to be decreased to 0.30 ppm or less. However, in the above examples in which a baking treatment was applied at an elevated temperature, the time until occurrence of red rust in the salt spray test was less than 7000 hours and decrease in the corrosion resistance by a baking treatment was observed. When the crack introducing step is not applied, it is difficult to stably achieve both of the significant decrease in the diffusible hydrogen concentration in the base steel sheet and the inherent corrosion resistance of a hot-dip Zn—Al—Mg-based plating layer.

When a baking treatment was applied after introducing cracks into a plating layer (Tables 4 and 5), the diffusible hydrogen concentration in a base steel sheet was able to be stably decreased to 0.30 ppm or less even with a baking treatment temperature of 150° C. or lower. It was found in all the examples that the time until occurrence of red rust in the salt spray test was 7000 hours or more and the coating layer after the baking treatment had an excellent rustproofing effect as with general hot-dip Zn—Al—Mg-based plating layers. However in Test Nos. 39 and 69, since the baking treatment temperature was so low as 50° C., the effect of decreasing the diffusible hydrogen concentration was insufficient. In examples where the baking treatment temperature was set to a temperature higher than 150° C. (Sample Nos. 47, 48, 54, 77, 78, and 84), decrease in the corrosion resistance was recognized. In comparison between Table 3 and Table 4, no difference in the corrosion resistance (rustproofing performance) was recognized depending on whether a crack was present in the coating layer. In the examples where a baking treatment was performed under a steam atmosphere, a black-tone appearance with a lightness of 60 or less was obtained except for an example in which the baking treatment temperature was so low as 50° C. (Sample No. 69). It was found that the appearance can be adjusted to a deeper black appearance with a lightness L* of 40 or less.

(Bending Test)

Next shown was a test example in which the effect of the diffusible hydrogen concentration in the base steel sheet on the bending workability was investigated using plated steel sheets (sheet thickness 1.0 mm) of the steel No. D. The Zn—Al—Mg-based-coated steel sheet samples of Sample Nos. 10, 40, and 70 shown in Tables 3 to 5 were subjected to a 135° V bending test at room temperature according to the V block method of JIS Z2248:2006 using a 45° pushing metal fitting so that the bending axis is parallel to the sample rolling direction. The V bending test was performed using various pushing metal fittings having different radii of curvature of the tip end and the surface of the portion subject to bending working was visually observed after the test to determine the minimum bending radius MBR (mm) at which no fracture was caused. The results are shown in Table 6.

TABLE 6

| Sample No. | Plated steel sheet No. | Crack introducing step Total elongation (%) | Baking treatment step Atmosphere | Baking treatment step Temperature (° C.) | Baking treatment step Time (h) | Zn—Al—Mg-based-coated steel sheet Diffusible hydrogen concentration in base steel sheet (ppm) | Zn—Al—Mg-based-coated steel sheet MBR in 135° bending test (mm) | Classification |
|---|---|---|---|---|---|---|---|---|
| 10 | D-1 | 0 | Air | 110 | 24 | 0.35 | 1.0 | Comp. Ex. |
| 40 | D-2 | 0.2 | Air | 110 | 24 | 0.09 | 0.25 | Inv. Ex. |
| 70 | D-2 | 0.2 | Steam | 110 | 24 | 0.09 | 0.25 | Inv. Ex. |

Hatching: inadequate production conditions/underlined: outside the range defined as the Inventive material In Inventive Examples in which the diffusible hydrogen concentration in the base steel sheet was lowered, the bending workability is significantly enhanced as compared with Comparative Examples. By a technique of applying a baking treatment after introducing cracks in a coating layer, hydrogen embrittlement can be eliminated to significantly enhance the workability.

The invention claimed is:

1. A surface-coated steel sheet comprising:

a base steel sheet having a steel composition by mass of C: 0.01 to 0.20%, Si: 0.01 to 0.50%, Mn: 0.10 to 2.50%, P: 0.005 to 0.050%, B: 0.0005 to 0.010%, Ti: 0.01 to 0.20%, Nb: 0 to 0.10%, Mo: 0 to 0.50%, Cr: 0 to 0.50%, Al: 0.01 to 0.10%, and the balance of Fe and inevitable impurities; and a Zn-Al-Mg-based coating layer disposed on a surface of the base steel sheet, the Zn-Al-Mg-based coating layer having a metal element composition ratio by mass of Al: 1.0 to 22.0%, Mg: 1.3 to 10.0%, Si: 0 to 2.0%, Ti: 0 to 0.10%, B: 0 to 0.05%, Fe: 2.0% or less, and the balance of Zn and inevitable impurities, and having cracks of which a total extension per $mm^2$ is 3.0 to 8.0 mm measured by scanning electron microscopic observation, the surface-coated steel sheet having a diffusible hydrogen concentration in the base steel sheet of 0.20 ppm or less and having a time until occurrence of red rust of 7000 hours or more as measured by a neutral salt spray test (salt concentration: 50g/L, temperature: 35° C., back face and edge face seal of test piece: present) according to JIS Z2371: 2015, wherein the surface-coated steel sheet has a tensile strength in a rolling direction of 590 MPa or higher and 855 MPa or less.

2. The surface-coated steel sheet according to claim 1, wherein the Zn-Al-Mg-based coating layer has a mean thickness of 3 to 100 μm.

3. The surface-coated steel sheet according to claim 1, wherein a surface of the coating layer has a lightness L* of 60 or less, wherein L* is a lightness index L* in the CIE 1976 L*a*b* color space.

4. The surface-coated steel sheet according to claim 1, further comprising an inorganic coating on a surface of the Zn-Al-Mg-based coating layer.

5. The surface-coated steel sheet according to claim 1, further comprising an organic coating on a surface of the Zn-Al-Mg-based coating layer.

6. A method for producing the surface-coated steel sheet according to claim 1, the method comprising:

a step of heating a base steel sheet having the steel composition in a mixed gas of hydrogen and nitrogen to 550 to 900° C., then immersing the heated steel sheet in a hot-dip plating bath having a composition by mass of Al: 1.0 to 22.0%, Mg: 1.3 to 10.0%, Si: 0 to 2.0%, Ti: 0 to 0.10%, B: 0 to 0.05%, Fe: 2.0% or less, and the balance of Zn and inevitable impurities using hot-dip plating equipment without exposed to the air atmosphere to produce a hot-dip Zn-Al-Mg-based-plated steel sheet (hot-dip plating step);

a step of imparting a strain of a total elongation rate of 0.2 to 1.0% to the hot-dip Zn-Al-Mg-based-plated steel sheet using any one or both of a tension leveler and a rolling mill to introduce a crack into a plating layer (crack introducing step); and a step of heating and holding the hot-dip Zn-Al-Mg-based-plated steel sheet having a crack introduced at 70 to 150° C. to decrease a diffusible hydrogen concentration in the base steel sheet to 0.30 ppm or less (baking treatment step).

7. The method for producing the surface-coated steel sheet according to claim 6, wherein the diffusible hydrogen concentration in the base steel sheet is decreased to 0.20 ppm or less in the baking treatment step.

8. The method for producing the surface-coated steel sheet according to claim 6, wherein the plated steel sheet to be subjected to the baking treatment step has a diffusible hydrogen concentration in the base steel sheet of 0.35 ppm or more.

9. A method for producing the surface-coated steel sheet according to claim 1, the method comprising:

a step of heating a base steel sheet having the steel composition in a mixed gas of hydrogen and nitrogen to 550 to 900° C., and then immersing the heated steel sheet in a hot-dip plating bath having a composition by mass of Al: 1.0 to 22.0%, Mg: 1.3 to 10.0%, Si: 0 to 2.0%, Ti: 0 to 0.10%, B: 0 to 0.05%, Fe: 2.0% or less, and the balance of Zn and inevitable impurities without exposed to the air atmosphere using hot-dip plating equipment to produce a hot-dip Zn-Al-Mg-based-plated steel sheet (hot-dip plating step);

a step of imparting a strain of a total elongation rate of 0.2 to 1.0% to the hot-dip Zn-Al-Mg-based-plated steel sheet using any one or both of a tension leveler and a rolling mill to introduce a crack into a plating layer (crack introducing step); and a step of heating and holding the hot-dip Zn-Al-Mg-based-plated atmosphere to bring a surface of the plating layer into contact with steam, thereby decreasing a diffusible hydrogen concentration in the base steel sheet to 0.30 ppm or less (baking treatment step).

* * * * *